United States Patent [19]

Kaarup

[11] 4,358,652

[45] Nov. 9, 1982

[54] FLUID HEATER APPARATUS

[76] Inventor: Darrell R. Kaarup, 532 W. 3rd., Canton, S. Dak. 57013

[21] Appl. No.: 131,219

[22] Filed: Mar. 17, 1980

Related U.S. Application Data

[63] Continuation-in-part of Ser. No. 971,754, Dec. 21, 1978, abandoned.

[51] Int. Cl.[3] ..... H05B 6/78; F24H 1/16

[52] U.S. Cl. ..... 219/10.55 A; 219/10.55 R; 219/10.55 B; 219/303; 219/309; 237/8 A

[58] Field of Search ..... 219/10.55 R, 10.55 A, 219/10.55 B, 10.65, 10.51, 282, 303, 304, 309, 314, 321, 328, 330, 350; 237/8 R, 8 A, 8 B, 8 C, 8 D, 56

[56] References Cited

U.S. PATENT DOCUMENTS

| | | | |
|---|---|---|---|
| 1,122,892 | 12/1914 | Farrand | 219/10.51 |
| 2,884,197 | 4/1959 | Whittell, Jr. | 237/8 C |
| 2,978,562 | 4/1961 | Fox | 219/10.51 |
| 3,494,724 | 2/1970 | Gray | 219/10.55 R |
| 3,812,315 | 5/1974 | Martin | 219/10.65 X |
| 3,816,689 | 6/1974 | Long | 219/10.55 R X |
| 3,920,945 | 11/1975 | Smith et al. | 219/10.55 R |
| 4,029,927 | 6/1977 | McMillan | 219/10.55 R |
| 4,152,567 | 5/1979 | Mayfield | 219/10.55 A |

*Primary Examiner*—B. A. Reynolds
*Assistant Examiner*—Philip H. Leung
*Attorney, Agent, or Firm*—Hill, Van Santen, Steadman, Chiara & Simpson

[57] ABSTRACT

A fluid heater apparatus for providing heated fluid on demand, the apparatus including at least two microwave heating units with coiled tubing disposed in the microwave field and connected to a valving and electrical system wherein heated fluid is supplied alternately from the units thus permitting one unit to heat fluid therein and the other to supply heated fluid therefrom and thereby supply a continuous flow of heated fluid and yet providing no storage facilities for holding heated fluid other than the coiled tubing in the microwave field.

8 Claims, 5 Drawing Figures

FLUID HEATER APPARATUS

CROSS-REFERENCE TO RELATED APPLICATION

The present application is a continuation-in-part of my earlier filed application, U.S. Ser. No. 971,754, filed Dec. 21, 1978, now abandoned and entitled "FLUID HEATER APPARATUS".

BACKGROUND OF THE INVENTION

In a majority of situations, commercial, industrial and residential, plumbing entails the installation of separate hot and cold water systems. Hot water is supplied from a conventional, centrally located heater system which heats and holds a specific volume of water at a selected temperature until there is a demand for the hot water. This conventional system results in a considerable waste of energy in maintaining the proper temperature. The heater and reservoir is either substantially overdesigned in the heating characteristics and storage capacity or substantially underdesigned, and therefore, inadequate during peak hours of use.

In any event, maintaining the temperature of large quantities of water at a predetermined temperature during periods of no demand or light demand results in an unnecessary demand on a decreasing energy supply.

Microwave heaters can supply substantially an instant supply of hot water. However, present design limits the quantity of hot water to the capacity of the heater. Energy conservation and rising consumer consumption throughout society are opposed problems and can be met by a new approach to the supply of water without the utilization of a reservoir wherein an alternating supply of heated water is supplied from at least a pair of microwave units.

SUMMARY OF THE INVENTION

This invention relates to an improved water heater apparatus designed for use in virtually any setting where a standard source of electrical power is available.

A primary object of the invention is not only to provide an immediate and continuous supply of heated fluid upon user demand, but also to reduce significantly the amount of energy utilized in meeting the user's demand as compared to the amount of energy presently required with the use of conventional fluid heaters.

The inventive water heater includes a storage coil for a quantity of water to be heated only on demand. The storage coil is located with respect to a heater unit such that the quantity of water retained within the storage coil may be quickly heated on demand. The storage coil has an input port and an output port and electrically actuated control valves which control the entry of cold water into the storage coil. A flow detector is connected adjacent the output side of the hot water heater, on or near a selected point on the associated hot water distribution system.

When the flow detector senses that water is being demanded from the hot water system, it generates a corresponding electrical signal which is sensed by an electrical control circuit connected to the heater and the electrically operated valves in the system. The control circuitry then enables the heater unit which in turn heats the water in the heating coil. When the water in the heating coil reaches a predetermined temperature, as sensed by a thermostat, the electrically controlled valve is actuated permitting the heated water in the heating coil to enter the hot water distribution system and replacement cold water to enter the heating coil.

A second heating coil and heater unit can be connected in parallel with the first heating coil and heater unit with the electrical control circuit then switching the two heater units on and off alternately thereby alternately heating two different volumes of water. By alternately opening the electrically controlled valve associated with each of the two heating coils, a continuous stream of hot water may be provided to the hot water distribution system without heating at any one time more than the volume of water contained within one heating coil.

Further, if desired, a controlled by-pass pipe may be provided between the cold water input side and the hot water output side of the inventive water heater. The purpose of the controlled by-pass pipe is to provide a path for cold water to flow into the hot water distribution system when an initial demand is made for hot water. The flowing cold water is sensed by the flow detection means and the control circuitry then, as described previously, heats the water in the heating coil.

The water may be heated by any high speed heating apparatus such as a microwave heater, an induction heater or a high speed resistance heater.

BRIEF DESCRIPTION OF THE DRAWINGS

In the drawings, as hereinafter described, a preferred embodiment of this invention is illustrated, however, various modifications can be made thereto without departing from the true spirit and scope of the invention.

DESCRIPTION OF THE PREFERRED EMBODIMENTS

Figure 1:
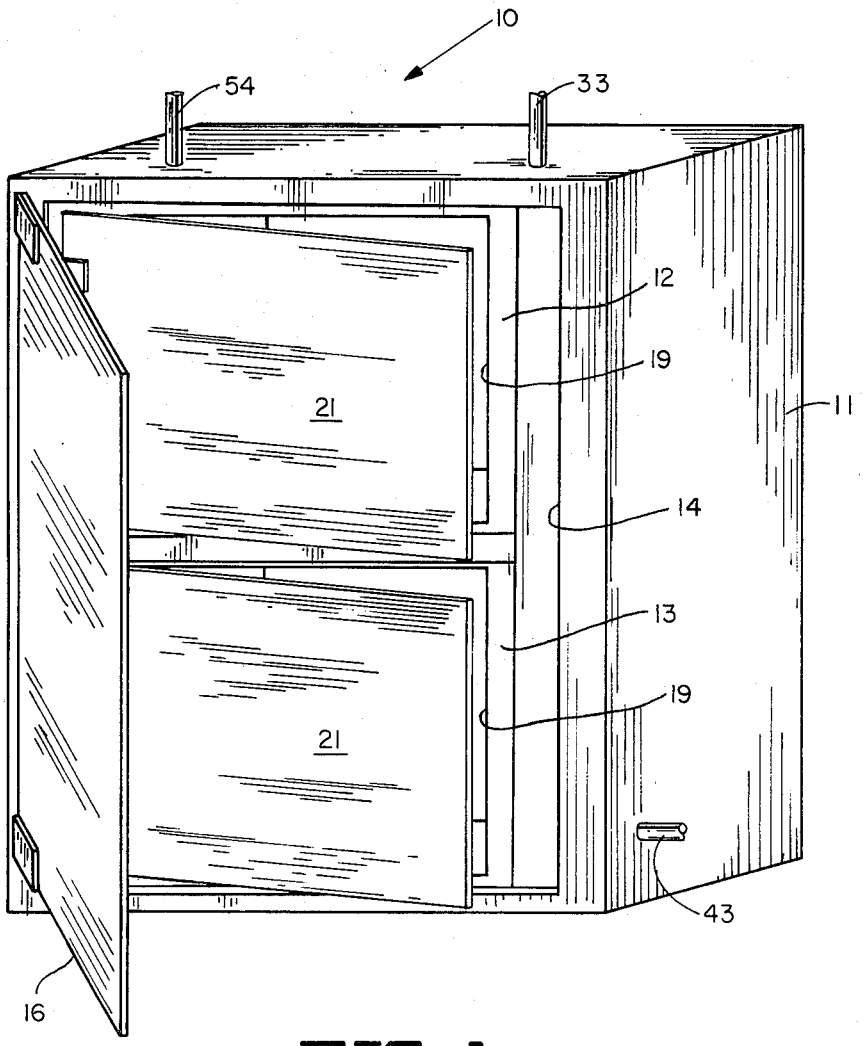
FIG. 1 is a perspective view of the apparatus of this invention.
Figure 2:
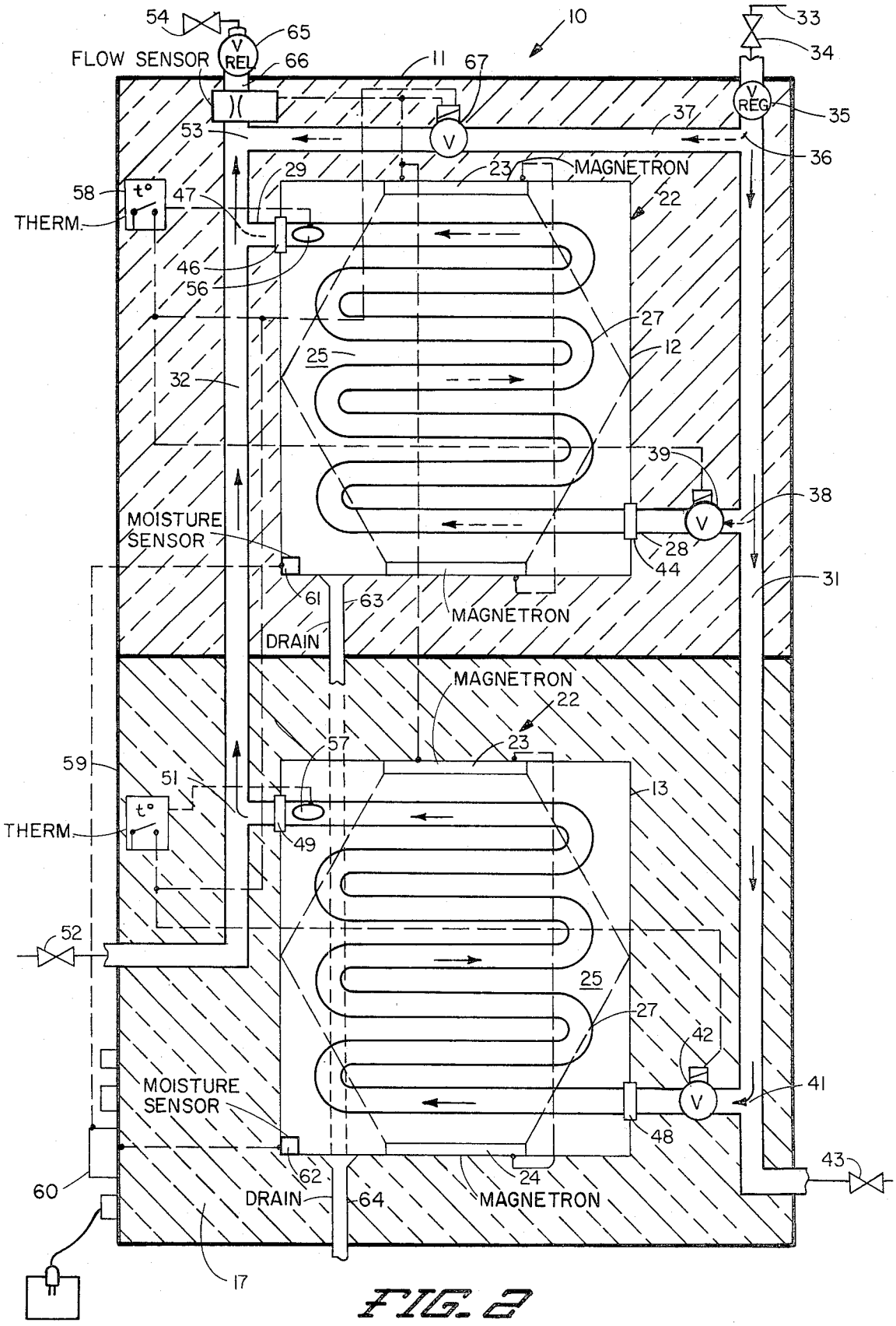
FIG. 2 is a schematic view of the elements of the apparatus.

Referring now to the drawings, the apparatus for heating fluids of this invention is depicted generally by the numeral 10. The apparatus includes an exterior housing 11 and a pair of spaced shielding cases 12 and 13. The housing can be metallic, plastic, plexiglas or the like, and has a plurality of openings formed therein to permit fluid conduits and electrical lines to enter or egress therefrom. In addition, an opening 14 is also provided in the housing to permit the repair and maintenance of the elements disposed therein. Hingedly mounted to the housing and covering the opening 14 is a door 16. Disposed within the housing are the shielding cases 12 and 13 and disposed between the cases and the housing is insulation 17. Openings are provided in each case to receive fluid conduits and electrical lines. An access opening 19 is provided in each case and a door 21 is mounted thereover and connected to each case by hinges.

Disposed within each casing is a microwave unit 22 having a primary magnetron 23, and a secondary magnetron 24. Mounted within each case 12 and 13 and disposed within the wave field 25 is a length of coiled tubing 27, the tubing having an inlet end 28 and an outlet end 29. The inlet and outlet ends 28 and 29 extend through the openings provided in the case and fluidly connect to an inlet pipe 31 or outlet pipe 32, respectively.

The inlet pipe 31 is connected to a supply pipe 33 from a conventional source of pressurized fluid. The two pipes 31 and 33 are separated by manually operated on-off valve 34, thus facilitating the installation and repair of the plumbing within the apparatus. Downstream of the on-off valve 34 is a pressure control valve 34 which permits the adjustment of the pressure of the incoming fluid.

The inlet pipe 31 downstream of the pressure valve 35 has a tee 36 fluidly interconnected therein with the free discharge end thereof connected to one end of a by-pass pipe 37. Downstream of the first tee 36 is a second tee 38 having its free discharge end connected to a first zone valve 39. Downstream of the second tee 38 is a third tee 41 having its free discharge end connected to a second zone valve 42. An auxiliary tap 43 or the like is connected to the other end of the intake pipe 31.

Referring now to the first zone valve 39, the free end thereof is shown as being connected to the inlet end 28 of the first coiled tubing 27. The tubing 27 passes through a first deflecting foil 44, into the first case 12, then through the first magnetron wave field 25 to a second deflecting foil 46, and then into the outlet pipe 32 at a discharge tee 47. The second zone valve 42 is connected to the inlet end of the second coiled tubing 27 which also passes through a deflecting foil 48 into the second wave field 25, through a fourth deflecting foil 49 and into a second discharge tee 51, which in turn is connected to the outlet pipe 32. One end of the outlet pipe 32 is connected to an auxiliary tap 52 or the like. The outlet pipe 32 is further connected at a fourth tee 53 to the other end of the by-pass pipe 37 and then continues to the conventional taps 54.

Mounted in each coiled tubing 27 proximate the discharge tee 47 or 51, is a heat sensor bulb 56 or 57. Each bulb is electrically connected to a thermostat 58 or 59 which in turn are electrically connected to the zone valves 39 or 42, respectively. Each zone valve is operated by its respective thermostat. Moisture sensing devices 61 or 62 are placed in the bottom of each case 12 or 13 to detect any leakage of fluid therein. Each sensing device is electrically connected to the electrical circuit 60 of the apparatus for the purpose of shutting off the supply of electricity in the event of leakage. Safety drain systems 63 and 64 are provided in the cases 12 and 13, respectively, to permit draining in the event of leakage. In addition, a pressure relief valve 65 is connected to the outlet pipe 32 to prevent an excessive build-up of pressure within the apparatus 10. Upstream of the pressure relief valve 65 is a flow detector and meter device 66. A normally closed valve 67 is mounted in the by-pass pipe 37 and electrically connected to the flow detector and meter device 66. The flow detector and meter device 66 is also electrically connected to the magnetron and the zone valves.

To actuate the microwave units 22, the conventional tap 54 is opened. The flow of liquid through the flow detector and meter device 66 causes the normally closed valve 67 to open and fluid to flow from the supply pipe 33 through the by-pass line 37 and to the tap 54. Simultaneously, both zone valves 39 and 42 are closed, both magnetrons are energized, thus creating a microwave field which heats the water in the coiled tubing 27. The heated water upon reaching a predetermined temperature at the bulb 56 causes the thermostat to send an electrical signal to the zone valve 39, and the now open valve 67, wherein the former opens and the latter closes, and the heated water in the tubing 27 in the case 12 flows to the conventional tap 54. When the heated water has passed the bulb 56 and cool water reaches the bulb, the thermostat 58 closes the zone valve 39 and activates the thermostat 59 mounted in the second case 13 and opens the valve 67 in the by-pass line 37. The temperature of the water in the coiled tubing 27 in the second case, upon reaching a predetermined temperature, activates the second thermostat 59 which now closes the valve 67 and opens the zone valve 42. Water thus flows alternately from the two units thus providing a continuous flow of heated water as the conventional tap 54. As water flows from one unit, the other unit is heating the water therein. It can thus be seen that substantially no water is being stored in a heated condition and that upon demand the system supplies the necessary heat. In the event a greater supply of heated water is required, it is only necessary to add additional units in parallel.

The deflecting foils, shielded cases, moisture sensing devices and drain systems are provided for safety purposes. The primary and secondary magnetrons are electrically interconnected to permit only one to operate when the water reaches a predetermined temperature.

Figure 3:
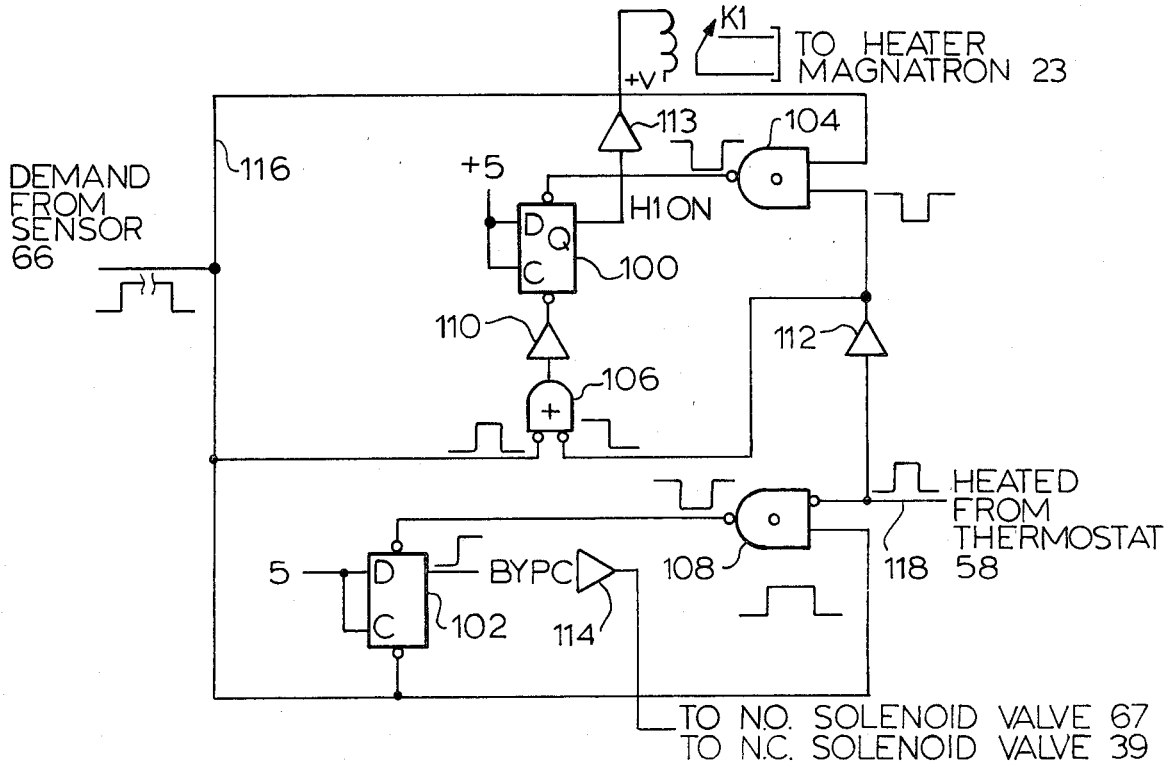
FIG. 3 is a schematic of an exemplary control circuit with one heater and one reservoir.

FIG. 3 is an exemplary schematic of a control circuit which is usable with the heater apparatus 10 wherein for purposes of energy conservation, or for purposes of very limited demand, only one heating section, such as the upper section 22 of the water heater 10 needs to be used, along with only one heater unit 23.

The control circuit of FIG. 3 includes D-type flip-flop elements 100, 102, NAND gates 104 through 108, inverters 110, 112, and drivers 113, 114. Each of the elements 100 through 114 may be, for example purposes, a member of the Texas Instruments 7400 series of integrated circuits. Each of the two input NAND gates may be SN74LS00 type chips, each of the inverters might be SN74LS05 type chips, each of the D-flip-flops might be SN74LS74 type chips, and each of the drivers might be SN74LS06 type chips.

When the flow meter 66 senses a demand, an up going signal is generated on a line 116 as shown in FIG. 3. This signal is present throughout the entire time that a demand for hot water is made on the heater 10. The thermostat 58 supplies a signal to a line 118 as shown in FIG. 3. When the water in the coil 27 has a temperature below that set on the thermostat 58, the signal on the line 118 is low. When the water in the coil 27 has been heated to the selected temperature, the signal on the line 118 generated by the thermostat 58 goes high. That signal stays high until the water in the coil 27 again cools off and needs to be heated.

The combination of a positive demand signal on the line 116 and a low thermostat signal on the line 118, which is inverted in the inverter 112, enables the gate 104 which supplies a low signal to the set input of the flip-flop 100. The output of the flip-flop 100 labelled H10N is coupled through the driver 113 to the coil of a relay K1. When the relay K1 is energized, it switches the heater magnetron 23 on. Any time the flip-flop 100 is set, the magnetron 23 will be energized and the microwaves generated by the magnetron 23 will heat the water in the coil 27. When the water in the coil 27 has been heated, the signal on the line 118 goes high and that high-going signal along with the fact that the demand signal on the line 116 is high energizes the NAND gate 108 which sets the D-flip-flop 102. When the D-flip-flop 102 is set, its output on the line BYPC goes high. The line 126 is connected to the driver 114. The driver 114 closes the normally open solenoid by-pass valve 67, and opens the normally closed solenoid water supply valve 39. When the valve 67 is closed, and the valve 39 is open, water will flow from the heater coil 27 due to pressure in the water in the intake pipe 33 through the coil 27, past the sensor 56 through the tee 47, and out through the output pipe 54 to the water system. During the time that the signal on the line 118 is high indicating that the water in the coil 27 is adequately hot, the gate 106 will be enabled which resets the D-flip-flop 100 which provides drive power to the heater magnetron 23. If the demand continues to be present on the line 116, and the signal on the line 118 drops down again, the flip-flop 100 will be set again, thus reenergizing the magnetron 23 and again heating the water in the coil 27.

Figure 4:
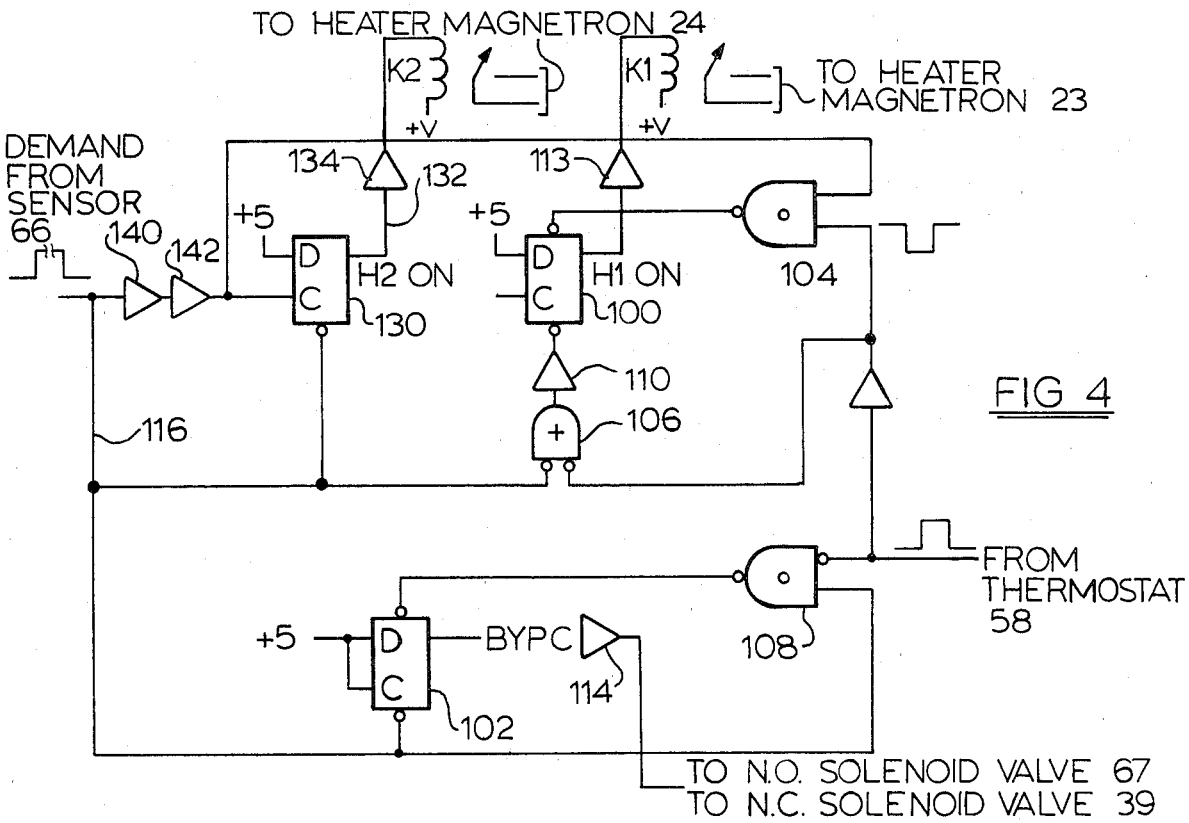
FIG. 4 is a schematic of an exemplary control circuit with two heaters and one reservoir.

FIG. 4 discloses an exemplary control circuit usable with two heater elements 23, 24 instead of one element, as in FIG. 3. Those circuit elements which are common between FIGS. 3 and 4 have the same number in each instance. Additionally, in FIG. 4, there is a second D-type heater flip-flop 130 which is connected by a line 132 to the driver 134 and to a relay K2. When the coil K2 is energized, its associated contacts are closed. The heater magnetron 24 is turned on and it heats the water in the coil 27 in parallel with the heater element 23. The circuit of FIG. 4 also includes two additional inverter units 140, 142. The circuit of FIG. 4 works the same way as does the circuit of FIG. 3 except that once the demand signal is sensed on the line 116, the flip-flop 130 continues to stay set, hence continually powering the magnetron 24 until the demand signal on the line 116 goes low again. When the demand signal on the line 116 goes low, the flip-flops 100, 102, 130 of the circuit of FIG. 4 are all reset.

Figure 5:
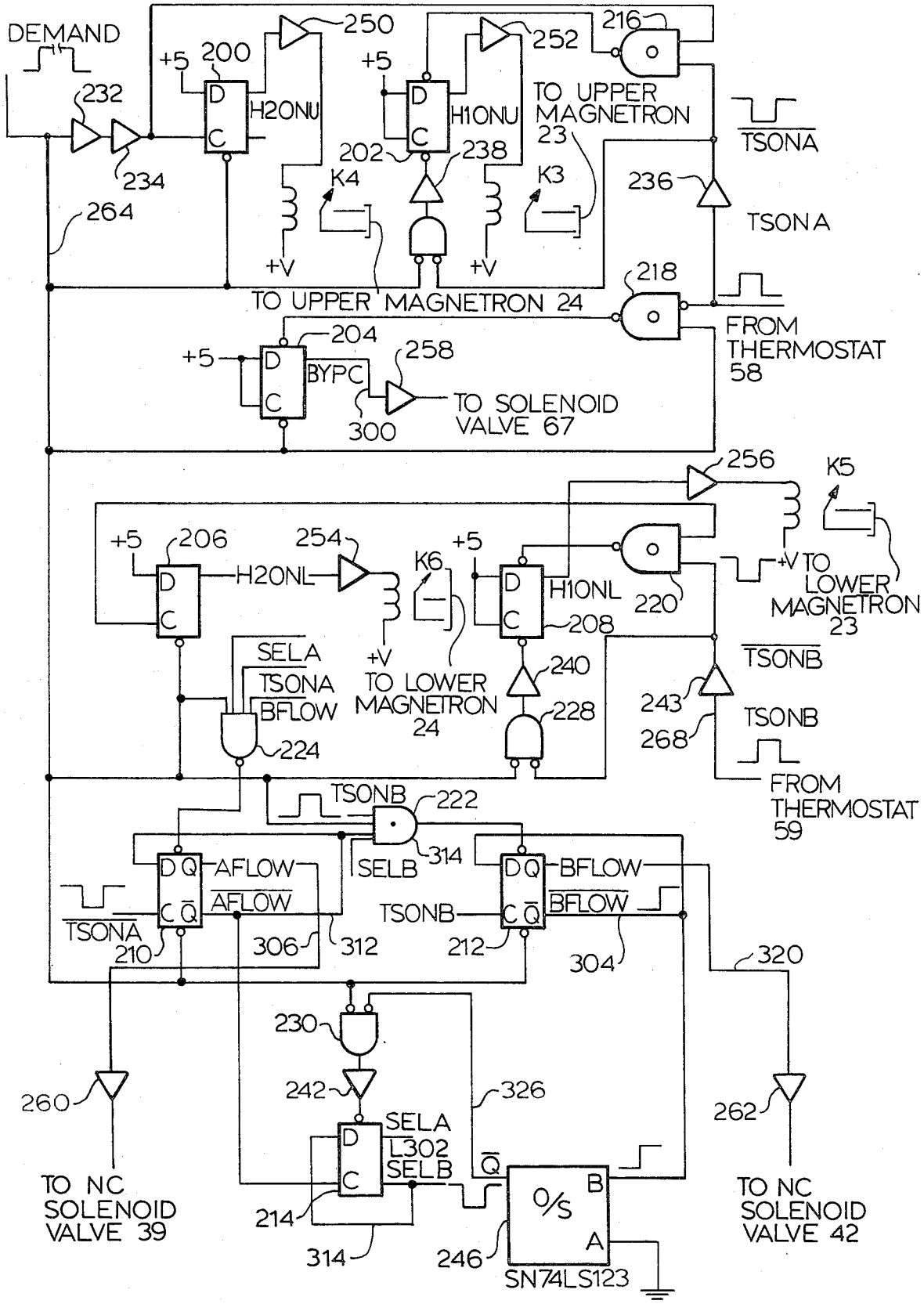
FIG. 5 is a schematic of an exemplary control circuit for use with dual heaters and dual reservoirs.

FIG. 5 is an exemplary control circuit usable with the heater 10 wherein both heating chambers, the upper chamber 22 and the lower chamber 22, are to be used alternately. The control circuit of FIG. 5 includes D-flip-flop units 200 through 214, NAND gates 216 through 230, inverters 232 through 243, one-shot 246, driver circuits 250 through 262 and relay coils K3 through K6. A positive going demand signal on a line 264 is supplied to the control circuit of FIG. 5 from the flow meter 66 during the time that there is a demand for hot water from the heater 10. Thermostat feedback signals are supplied on a line 266 and on a line 268 from the thermostat 58 and from the thermostat 59.

The operation of the heater control flip-flops 200, 202 and 206, 208 is respectively comparable to the operation of the heater control flip-flops 130, 100 of FIG. 4. When a demand signal is sensed on the line 264, that positive going signal is transmitted through the inverters 232, 234 to set the flip-flops 200, 206. Additionally, the demand signal is transmitted through the gates 216, 220 to also set respectively the flip-flop units 202, 208. When the signal from the thermostat 58 on the line 266 goes up indicating that the water in the upper coil 27 is hot and ready for use, the gate 218 is enabled, setting the by-pass valve control flip-flop 204. When the by-pass valve control flip-flop 204 is set, a high signal on a line 300 enables the solenoid driver 258 to close the normally open solenoid by-pass valve 67 in the by-pass pipe 37.

When the demand signal first appeared on the line 264, the select flip-flop 214 had been set through the action of a gate 230 and the inverter 242. Thus, the heated supply of water in the upper tube 27 will be supplied to the output pipe 54 by setting flip-flop 210 and energizing the normally closed solenoid valve 39 through the driver 260. The valve 39 is energized by the gate 224 being enabled. The gate 224 forms an AND of the select flip-flop output on the line 302, the demand signal on the line 264, the upgoing thermostat signal on the line 266, and a signal from a line 304 which indicates that the lower solenoid valve 42 has not been activated. When the gate 224 is enabled, the D-flip-flop 210 is set. A high signal is applied through the line 306 to the solenoid driver 260 to open the normally closed solenoid valve 39. Water will continue to flow out of the upper reservoir 27 until the thermostat signal on the line 266 goes down indicating that the water being sensed by the sensor 56 has gotten cold.

When the signal on the line 266 goes low indicating that the water in the upper reservoir 27 has gotten cold, that signal is inverted by the inverter 236 and that upward going edge triggers the flip-flop 210 causing it to change state. As a result, the output on the line 306 goes low disabling the driver 260 and permitting the normally closed solenoid valve 39 to close. Simultaneously, the negated output of the flip-flop 210 on a line 312 goes high, and is ANDED in the gate 222 with the thermostat signal on the line 268, which is high because the lower reservoir 27 contains hot water, along with the negated output on the line 312 from the flip-flop 210, the demand signal on the line 264 and a select B signal on a line 314 from the D-flip-flop 214. A downgoing signal on the output of the gate 222 sets the flip-flop 212. As a result, a high signal is applied to a line 320 which drives the solenoid driver 212 which in turn is connected to the normally closed solenoid valve 42. Thus, the valve 42 is opened, and the water pressure on the input pipe 33 drives the heated water in the lower coil 27 into the output pipe 54 and to the system. Water continues to flow out of the lower reservoir 27 until the sensor 57 associated with the lower reservoir 27 signals the thermostat 59 that it has sensed cold water. At this time, the thermostat signal on the line 268 goes low. The low-going signal on the line 268 is inverted by the inverter 243. The inverted signal from the output of the chip 243 is used as a clock input to the solenoid control flip-flop 212 resetting that flip-flop. When the flip-flop 212 is reset, its negated output on the line 304 goes high, triggering the one-shot 246. A short duration pulse on an output line 326 from the one-shot 246 is fed through the gate 230, the inverter 242, and sets the select flip-flop 214. With the select flip-flop 214 set, the solenoid valve 39 associated with the upper reservoir 27 is activated, as previously discussed. Thus, hot water will now flow from the upper reservoir 27 into the output pipe 54.

With respect to the control circuit of FIG. 5, the inverters, NAND gates, buffers and flip-flops may be of the same type of chips as were discussed previously with respect to FIGS. 3 and 4.

It will be understood, of course, that while the exemplary control circuits of FIGS. 3 through 5 have been shown implemented using integrated circuits, that alternate forms of implementation could be used. These alternate forms of implementation, such as relay circuits or discrete logic circuits would be fully equivalent to those disclosed in FIGS. 3 through 5.

It will further be understood that while the exemplary heater apparatus, as disclosed, uses magnetrons as the heating elements, any other type of high speed heating unit, such as a high speed resistive or inductive heater, could be utilized without departing from the spirit or scope of my invention.

While various modifications and changes might be proposed by those skilled in the art, it will be understood that I wish to include within the claims of the patent warranted hereon, all such changes and modifications as reasonably come within my contribution to the art.

I claim as my invention:

1. A fluid heater apparatus for providing heated fluids only on demand, the apparatus comprising:

a housing having a pair of spaced microwave units disposed therein;

piping means connectable on one end to a source of pressurized fluid, on the other end to a tap and having a portion between said ends disposed in both of said microwave units;

flow detecting means adapted to detect a fluid flow past said tap;

electrical circuitry means connected to a source of power and operably connected to said flow detecting means and said piping means to provide power thereto to permit fluid to flow alternately through said piping means disposed in said units and to provide power to said microwave units in response to said flow detecting means detecting a flow past said tap;

a thermostatic element connected to each unit and operatively connected to said piping means to control the flow of fluid therethrough in response to predetermined temperatures of the fluid;

said piping means includes an inlet pipe connectable to the source of fluid, a tubing for each microwave unit, said tubing are mounted in parallel, a temperature sensing bulb disposed in each tubing and electrically connected to said thermostatic element of its respective unit, valving connected to each tubing and operable in response to said electrical circuitry means, and an outlet pipe connected to said tubings and connectable to said tap, wherein said valving is operable to permit fluid to flow alternately from said tubings.

2. A fluid heater apparatus for providing heated fluids, the apparatus comprising:

a housing having a pair of spaced microwave units disposed therein;

piping means connectable on one end to a source of pressurized fluid, on the other end to a tap and having a portion between said ends disposed in both of said microwave units;

flow detecting means adapted to detect a fluid flow past said tap;

electrical circuitry means connected to a source of power and operably connected to said flow detecting means and said piping means to provide power thereto to permit fluid to flow alternately through said piping means disposed in said units and to provide power to said microwave units in response to said flow detecting means detecting a flow past said tap;

a thermostatic element connected to each unit and operatively connected to said piping means to control the flow of fluid therethrough in response to predetermined temperatures of the fluid;

said microwave units each have a primary and a secondary magnetron to provide a microwave field for heating a fluid only on demand to a predetermined temperature and for holding the fluid at that temperature;

said piping means includes an inlet pipe connectable to the source of fluid, a tubing for each microwave unit, said tubings are mounted in parallel, a temperature sensing bulb disposed in each tubing and electrically connected to said thermostatic element of its respective unit, valving connected to each tubing and operable in response to said electrical circuitry means, and an outlet pipe connected to said tubings and connectable to said tap, wherein said valving is operable to permit fluid to flow alternately from said tubings.

3. A fluid heater as defined in claim 2, and said piping means further including a by-pass line fluidly interconnecting said inlet pipe and said outlet pipe.

4. A fluid heater as defined in claim 3 and said electrical circuitry means including a flow sensing device to sense the flow of fluid and to electrically control said valving.

5. A fluid heater as defined in claim 4, and including a moisture sensing device mounted in each microwave unit and electrically connected to said flow sensing device, and said piping means including further an on-off valve mounted in said inlet pipe and electrically connected to said flow sensing device wherein when said moisture sensing device senses fluid said on-off valve is closed.

6. A fluid heater as defined in claim 5, and including a drain disposed in each microwave unit for draining any fluid that escapes said tubing.

7. An improved demand fluid heater for use in a hot fluid distribution system; the fluid heater having:

a first fluid retaining means of a selected volume in which the fluid to be heated is retained for a selected interval of time while being heated, the first fluid retaining means having a cold fluid input port and a hot fluid output port, the hot fluid output port being connectable to the hot fluid distribution system;

means for heating, only on demand, the fluid retained in the first fluid retaining means;

the improvement comprising:

electrically actuated flow control means, connected to the first fluid retaining means, to control the flow of hot fluid out of the first fluid retaining means;

demand detection means, selectively located to sense a demand for hot fluid, and to produce a demand indicating electrical signal corresponding thereto;

electrical control means connected to said means for heating, said flow control means and said flow detection means;

said electrical control means being operable to sense said demand indicating electrical signal, to only then enable said heating means only until the fluid in the first means for retaining has attained a selected temperature; to then enable said flow control means permitting the heated fluid in the first fluid retaining means to enter the hot fluid distribution system;

a controllable fluid conducting means connected as a by-pass between the input port and the output port of the first fluid retaining means and electrically connected to said electrical control means;

said controllable fluid conducting means being operable to provide an immediate supply of fluid to the hot fluid distribution system in response to a demand for hot fluid;

said demand detection means sensing the flow of fluid through said controllable fluid conducting means and into the hot fluid distribution system and generating, essentially simultaneously, said demand indicating signal;

said electrical control means blocking the flow of fluid through said controllable fluid conducting means simultaneously with enabling said flow control means thereby supplying heated fluid to the hot fluid distribution system.

8. The improved demand fluid heater, according to claim 7, with the improvement comprising further:

a second fluid retaining means with an input port and an output port;

said input port and said output port of said second fluid retaining means being connected in parallel with the input port and output port of the first fluid retaining means;

second means for heating only on demand, the fluid retained in said second fluid retaining means;

said electrically actuated flow control means being further connected to said second fluid retaining means, to control the flow of hot water out of said second fluid retaining means;

said electrical control means being connected to said second means for heating;

said electrical control means being further operable to alternately heat the fluid in the first retaining means and the fluid in said second retaining means to provide a continuous flow of heated fluid to the hot fluid distribution system in response to a demand for hot fluid which exceeds the quantity of fluid heated, at any one time, in the first and said second fluid retaining means.

* * * * *